US009233808B2

(12) United States Patent
Morimoto

(10) Patent No.: US 9,233,808 B2
(45) Date of Patent: Jan. 12, 2016

(54) PAPER FEEDER AND IMAGE FORMING APPARATUS

(71) Applicant: Sharp Kabushiki Kaisha, Osaka (JP)

(72) Inventor: Yasumasa Morimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/337,321

(22) Filed: Jul. 22, 2014

(65) Prior Publication Data

US 2015/0028535 A1 Jan. 29, 2015

(30) Foreign Application Priority Data

Jul. 25, 2013 (JP) ..... 2013-154429

(51) Int. Cl.

| | |
|---|---|
| ***B65H 7/08*** | (2006.01) |
| ***B65H 3/06*** | (2006.01) |
| ***B65H 7/02*** | (2006.01) |
| ***B65H 5/06*** | (2006.01) |
| *B65H 43/02* | (2006.01) |

(52) U.S. Cl.

CPC ..... *B65H 3/0684* (2013.01); *B65H 5/06* (2013.01); *B65H 7/02* (2013.01); *B65H 43/02* (2013.01)

(58) Field of Classification Search

CPC ..... B65H 7/02; B65H 43/02

See application file for complete search history.

(56) References Cited

U.S. PATENT DOCUMENTS 8,308,159 B1 * 11/2012 Manor et al. ..... 271/245
2013/0083376 A1 * 4/2013 Miura et al. ..... 358/498

FOREIGN PATENT DOCUMENTS

JP 2004-051253 A 2/2004

* cited by examiner

*Primary Examiner* — Howard Sanders

(74) *Attorney, Agent, or Firm* — Renner, Otto, Boisselle & Sklar, LLP

(57) ABSTRACT

A paper feeder includes a document loading tray 2, a pickup roller 5 and an actuator. The actuator protrudes on a stacking face of the paper sheet stacking tray 2 and senses a paper sheet when touched, pushed and moved by a front edge thereof that is set. The actuator includes a first actuator 21 and a second actuator 22 that are fixed on a common swing shaft. The first actuator 21 is an actuator adapted for paper sheets of first sizes in width direction. The second actuator 22, disposed within business card width at an inner position than the first actuator 21 in width direction, is an actuator adapted for paper sheets of small sizes under normal paper sizes. An end on sensing side 221 of the second actuator 22 is located upstream in paper feed direction from an end on sensing side 211 of the first actuator 21.

8 Claims, 7 Drawing Sheets

PAPER FEEDER AND IMAGE FORMING APPARATUS

CROSS REFERENCE

This Nonprovisional application claims priority under 35 U.S.C. §119(a) on Patent Application No. 2013-154429 filed in Japan on Jul. 25, 2013, the entire contents of which are hereby incorporated by reference.

BACKGROUND OF THE INVENTION

The present invention relates to a paper feeder that is incorporated in an image forming apparatus such as copier, multifunctional apparatus, facsimile equipment and/or the like, and to an image forming apparatus including the same.

In an automatic document feeder, there is provided a sensing member (actuator) that senses, when a paper sheet (document) is set at a predetermined position on a paper sheet stacking tray, that the paper sheet is set. That the paper sheet is set is sensed when a front edge of the paper sheet that comes into contact with the actuator causes the actuator to be swung toward a paper feed direction.

In order to adjust a timing of sensing properly depending on sizes in width of paper sheets of documents, a paper feeder that is disclosed in Japanese Patent Unexamined Publication No. 2004-51253 bulletin, for example, is provided with a first actuator that is adapted for paper sheets of relatively large sizes including normal paper sizes, and a second actuator that is disposed at an inner position than the first actuator in width direction and adapted for paper sheets of relatively small sizes.

Edges of ends on sensing sides (upstream sides in the paper feed direction) of the first actuator and the second actuator are parallel with each other, and incline at a same angle, while the end on the sensing side of the second actuator that is adapted for the paper sheets of small sizes is located on a downstream side, in the paper feed direction, from the end on the sensing side of the first actuator that is adapted for the paper sheets of large sizes including normal paper sizes. The first actuator and the second actuator are supported by a same swing shaft in such a manner that when either one of the actuators is swung, then operating together therewith, the other is also swung.

Also, it is disclosed that with the second actuator that is adapted for the paper sheets of small sizes being disposed within widths of business cards the above-mentioned paper feeder can deal with documents of sizes of business cards.

However, with the second actuator being disposed within the widths of business cards, although it can easily sense the business cards that are made of thick paper, there has been a problem that sensing mistakes occur in such cases as when a document of a normal paper size that is to be sensed by the first actuator is set but a front edge of the paper sheet is curled then the first actuator is not swung because the paper sheet curls up along the end on the sensing side of the first actuator nor does the front edge of the paper sheet come into contact with the second actuator of which end on the sensing side is located on the downstream side from the first actuator in the paper feed direction.

The present invention is directed to providing a paper feeder and an image forming apparatus including the same that is capable of surely sensing even a paper sheet of a normal paper size that is curled by using a first actuator that is adapted for paper sheets of large sizes including normal paper sizes and a second actuator that is disposed within widths of business cards.

SUMMARY OF THE INVENTION

A paper feeder of the present invention includes a paper sheet stacking tray, a pickup roller and an actuator. The pickup roller feeds a paper sheet that is set on the paper sheet stacking tray. The actuator protrudes on a stacking face of the paper sheet stacking tray, and senses a paper sheet when touched, pushed and moved by a front edge of the paper sheet that is set. The actuator includes a first actuator and a second actuator. The first actuator is an actuator adapted for paper sheets of first sizes in width direction. The second actuator is an actuator adapted for paper sheets of second sizes that are smaller than any first size in width direction. And, an end on sensing side of the second actuator is located on an upstream side from an end on sensing side of the first actuator in a paper feed direction. The first actuator and the second actuator are fixed on a common swing shaft, thereby being capable of simplifying the structure. This configuration ensures that the second actuator that is located on the upstream side in the paper feed direction can sense that a paper sheet is set on the paper sheet stacking tray even when a front edge of the paper sheet of a first size that is to be sensed by the first actuator is curled.

Further, in the present invention, the end on sensing side of the second actuator has a first oblique section, a flat section and a second oblique section. The first oblique section inclines from underside toward upside in height direction toward a downstream side in the paper feed direction. The flat section has an inclination that is nearly horizontal, and is connected to the first oblique section. The second oblique section is connected to the flat section, and has an inclination angle that is smaller than that of the first oblique section.

With the inclination angles from underside toward upside that are configured so as to decrease in two stages toward the downstream side in the paper feed direction in this manner at the end on sensing side of the second actuator that senses paper sheets of the second sizes, the second actuator can surely sense a paper sheet of a small size that is set on the paper sheet stacking tray, because a front edge of even a paper sheet that is curled downward comes into contact with the first oblique section having a large inclination angle and surely pushes, moves and thereby swings the first oblique section. This configuration allows paper sheets of the small sizes to be set in such a manner as to be placed on the flat section between the first oblique section and the second oblique section, thereby increasing degree of freedom in the manner of setting a document.

The end on sensing side of the first actuator has a first oblique section and a second oblique section. The first oblique section inclines from underside toward upside in height direction toward the downstream side in the paper feed direction. The second oblique section is connected to the first oblique section, and has an inclination angle that is larger than that of the first oblique section.

With the inclination angles from underside toward upside that are configured so as to increase in two stages toward the downstream side in the paper feed direction in this manner at the end on sensing side of the first actuator that senses paper sheets of the first sizes, the first actuator can surely sense that even a paper sheet that is curled upward is set on the paper sheet stacking tray, because the paper sheet that is curled upward comes into contact with the second oblique section and thereby swings the second oblique section even when it slips off the first oblique section.

The inclination angle of the first oblique section of the second actuator is configured so as to be larger than that of the first oblique section of the first actuator. This ensures that the first oblique section having a large inclination angle and the flat section of the end on sensing side of the second actuator are located on the upstream side from the first oblique section of the end on sensing side of the first actuator in the paper feed direction, even though the first actuator and the second actuator are fixed on the common swing shaft.

The paper feeder has a movable pickup holder that supports a pickup roller rotatably. In this case, in a direction perpendicular to the paper feed direction, the second actuator is disposed within a width of the pickup holder, and the first actuator is disposed outside the width of the pickup holder. What makes it possible to have such an arrangement is that a height of the second actuator is configured so as to be lower than a height of the first actuator. This permits the first and the second actuators that protrude from the stacking face of the paper sheet stacking tray to be disposed compactly.

According to the present invention, by using a first actuator that is adapted for paper sheets of large sizes including normal paper sizes, and a second actuator that is disposed within widths of business cards, even a paper sheet of a normal paper size that is curled can be sensed surely.

DETAILED DESCRIPTION OF THE INVENTION

Figure 1:
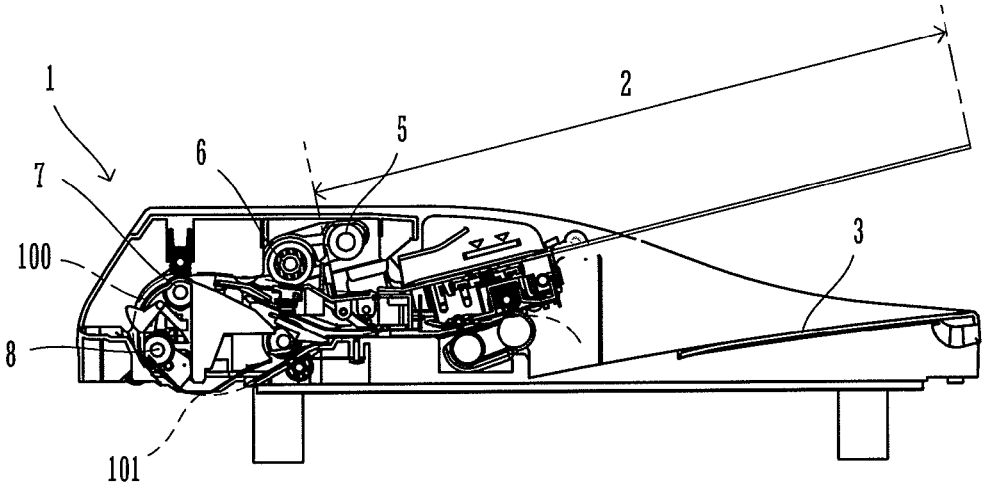
FIG. 1 is a side view of a paper feeder according to a first embodiment of the present invention.

A first embodiment of the present invention is explained below referring to the drawings.

Figure 7:
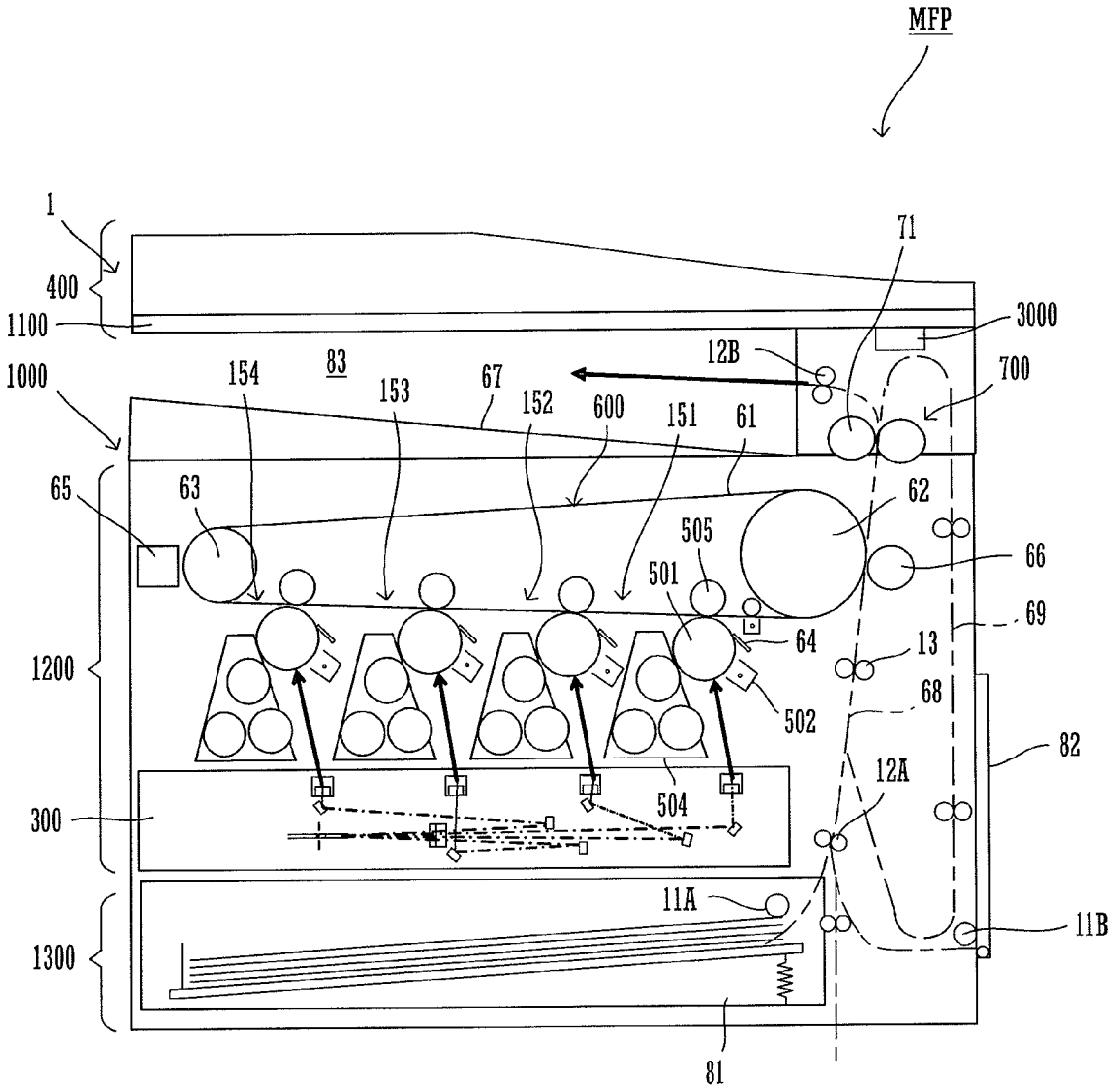
FIG. 7 is a sectional view showing a general configuration of an image forming apparatus according to the present invention.

As shown in FIG. 7, an image forming apparatus MFP includes a casing 1000, an automatic document feeder (ADF) 1 and a control section 3000. The casing 1000 takes a generally rectangular parallelepiped in shape.

The casing 1000 includes an image reading section 1100, an image forming section 1200 and a paper feeding section 1300. The image reading section 1100 is disposed at an upside of the casing 1000; the image forming section 1200 is disposed under the image reading section 1100; and the paper feeding section 1300 is disposed under the image forming section 1200. The image reading section 1100 and the ADF 1 constitute an image reading unit 400.

The image forming section 1200, so as to allow for a space 83 (so-called intra-body paper discharge section) between itself and the image reading section 1100 for accommodating a paper discharge tray 67 that receives paper sheets having undergone an image forming process, is formed in such a manner as to partially have a horizontal cross section that is smaller than the horizontal projection of the image reading section 1100. For the paper, recording media such as normal paper, photographic paper, OHP film and the like can be exemplified.

The image forming section 1200 includes an exposure unit 300, four image generating sections 151, 152, 153, 154, an intermediate transfer belt unit 600, a secondary transfer roller 66, a fuser unit 700, a paper discharge tray 67 and paper sheet conveying paths 68, 69, and carries out an image forming process onto a paper sheet.

The intermediate transfer belt unit 600 includes an intermediate transfer belt 61, a drive roller 62, an idle roller 63 and a tension roller (not shown). The intermediate transfer belt 61 is passed over the drive roller 62 and the idle roller 63, and forms a loop-like circular path. The intermediate transfer belt unit 600 and the secondary transfer roller 66 are one example of a transfer device of the present invention. The intermediate transfer belt 61 is an example of an endless belt of the present invention.

The image forming section 1200 performs an image forming process at the image generating sections 151, 152, 153, 154 using image data corresponding to respective hues of the four colors consisting of black, along with cyan, magenta, and yellow which are the three primary colors of the subtractive color mixture obtained from the color separation of a color image. The image generating sections 151-154 are disposed in alignment along a circular direction of the intermediate transfer belt 61. The image generating sections 152-154 are each configured substantially in the same manner as the image generating section 151.

The image generating section 151 for black includes a photoreceptor drum 501, an electrostatic charger 502, a developing device 504, a primary transfer roller 505 and a cleaning unit 64.

The electrostatic charger 502 causes a surface of the photoreceptor drum 501 to be charged uniformly to a predetermined electrostatic potential.

The exposure unit 300 includes a semiconductor laser, a polygonal mirror, a first fθ lens and a second fθ lens which are not illustrated, and emits respective laser beams that are modulated by the image data of the respective hues of black, cyan, magenta and yellow to the respective photoreceptor drums 501 of the image generating sections 151-154. On respective circumferential surfaces of the four photoreceptor drums 501, electrostatic latent images by the image data of the respective hues of black, cyan, magenta and yellow are formed. The exposure unit 300 is one example of an optical scanner of the present invention.

The developing devices 504 respectively supply toners (developers) of the respective hues of the image generating sections 151-154 onto the respective circumferential surfaces of the photoreceptor drums 501 on which the electrostatic latent images are formed, thereby rendering the electrostatic latent images visible in toner images.

The cleaning units 64 collect the toners remaining on the surfaces of the photoreceptor drums 501 after the developing and the image transferring have been performed.

An outer peripheral surface of the intermediate transfer belt 61 sequentially faces the four photoreceptor drums 501. The primary transfer rollers 505 are disposed at positions respectively facing the photoreceptor drums 501 across the intermediate transfer belt 61. The positions at which the intermediate transfer belt 61 and the photoreceptor drums 501 face each other are respectively positions where primary transfers are performed.

To the primary transfer rollers 505, in order to transfer the toner images that are respectively borne on the circumferential surfaces of the photoreceptor drums 501 onto the intermediate transfer belt 61, a primary transfer bias of a polarity (plus) reverse to an electrostatic charge polarity (minus) of the toners is applied respectively with a constant voltage control. This causes the toner images of the respective hues that have been formed on the respective photoreceptor drums 501 to be transferred (to undergo primary transfer) sequentially in such a manner as to be superimposed onto the outer peripheral surface of the intermediate transfer belt 61, thereby forming a full color toner image on the outer peripheral surface of the intermediate transfer belt 61.

However, in a case where image data on only part of the hues of yellow, magenta, cyan and black are inputted, electrostatic latent image(s) and toner image(s) are formed only at part of the drums corresponding to the part of the hues of the inputted image data among the four photoreceptor drums 501. For example, in monochromatic printing mode, formation of an electrostatic latent image and formation of a toner image are performed only on the photoreceptor drum 501 of the image generating section 151 that corresponds to the black hue, and only the black toner image is transferred (undergoes primary transfer) onto the outer peripheral surface of the intermediate transfer belt 61.

In full color image forming in which an image forming process is performed at all the image generating sections 151-154, the four primary transfer rollers 505 cause the intermediate transfer belt 61 to be in contact with all the photoreceptor drums 501 with pressure. On the other hand, in the monochromatic image forming in which an image forming process is performed only at the image generating section 151, the primary transfer roller SOS causes the intermediate transfer belt 61 to be in contact with the photoreceptor drum 501 with pressure only at the image generating section 151.

Each primary transfer roller 505 is made up of a shaft made of a metallic material such as stainless steel or the like of which surface is coated by an electrically-conductive elastomer, and applies a high voltage to the intermediate transfer belt 61 uniformly with the electrically-conductive elastomer.

The secondary transfer roller 66 is in contact with the drive roller 62 with a predetermined nip pressure sandwiching the intermediate transfer belt 61 in between. The secondary transfer roller 66 is made of an electrically-conductive resin and rigid material. The secondary transfer roller 66 performs a transfer (secondary transfer) of the toner image that is borne on the outer peripheral surface of the intermediate transfer belt 61 onto a paper sheet.

The toner images that have been transferred onto the outer peripheral surface of the intermediate transfer belt 61 at the respective primary transfer positions are conveyed, by a circular movement of the intermediate transfer belt 61, to the secondary transfer position at which the intermediate transfer belt 61 and the secondary transfer roller 66 face each other.

In a paper feed cassette 81 of the paper feeding section 1300, paper sheets are contained. To the paper sheet conveying path 68, a plurality of conveyance rollers 12A, 12B are disposed. The paper sheet conveying path 68, in order to deliver the paper sheets that are contained in the paper feed cassette 81 to the paper discharge tray 67 via the secondary transfer position (transfer section of the present invention) and the fuser unit 700, is disposed generally in vertical direction.

To the paper sheet conveying path 69, a plurality of conveyance rollers 12C, 12D are disposed. The paper sheet conveying path 69 is provided from a downstream side of the fuser unit 700 to an upstream side of the secondary transfer position in a conveyance direction of the paper sheet. To the paper sheet conveying path 69, a paper sheet that has passed the fuser unit 700 and is being discharged to the paper discharge tray 67 is conveyed with its then rear edge turned to front. With its both sides reversed in this manner, the paper sheet is conveyed again to the secondary transfer position.

Apart from the paper feed cassette 81, the paper feeding section 1300 includes a hand-fed paper tray 82. In the paper feed cassette 81 and on the hand-fed paper tray 82, paper sheets are contained and received, respectively.

The paper feeding section 1300 feeds the paper sheets piece by piece from either of the paper feed cassette 81 and the hand-fed paper tray 82. A paper sheet contained in the paper feed cassette 81 is fed by a pickup roller 11A, and is conveyed through the paper sheet conveying path 68 to the secondary transfer position. A paper sheet received on the hand-fed paper tray 82 is fed by a pickup roller 11B, and is conveyed through the paper sheet conveying path 68 to the secondary transfer position.

A paper stop roller 13 is disposed on the upstream side from the secondary transfer position in the paper sheet conveyance direction. The paper stop roller 13 starts rotating with a timing to cause the front edge of the paper sheet that has been fed from the paper feed cassette 81 or the hand-fed paper tray 82 to coincide with a front edge of the toner image that has been formed on the surface of the intermediate transfer belt 61, and then supplies the paper sheet to the secondary transfer position.

When the paper sheet that has been fed from the paper feeding section 1300 passes the secondary transfer position, a transfer voltage which is a high voltage having the same polarity (minus) as the electrostatic charge polarity (minus) of the toner is applied to the drive roller 62. This causes the toner image to undergo a secondary transfer from the outer peripheral surface of the intermediate transfer belt 61 onto the surface of the paper sheet.

The developers remaining on the intermediate transfer belt 61 after the toner image has been transferred onto the paper sheet are collected by an intermediate transfer belt cleaning unit 65.

The paper sheet onto which the toner image has been transferred is led to the fuser unit 700. The fuser unit 700 includes a heating roller 71 and a pressing roller 72. The pressing roller 72, being in contact with the heating roller 71 with pressure, together therewith constitute a fixing section, and the paper sheet onto which the toner image has been transferred is heated and pressed when passed through the fixing section. This causes the toner image to be fixed durably on one side of the paper sheet. The paper sheet on which the toner image has been fixed is discharged onto the paper discharge tray 67 with the side on which the toner image has been fixed facing down.

Subsequently, a paper feeder which is characteristic of the present invention is explained. In this embodiment, a paper feeder that is applied to the ADF 1 is explained as an example of the paper feeder. ADF is normally installed in most models of image forming apparatus (for example, multifunctional apparatus as referred to as MFP) as a device for use in high-speed image reading of a document loaded thereon.

As shown in FIG. 1, the ADF 1 includes a document loading tray 2 and a document receiving tray 3 mutually disposed in vertical arrangement; and a generally U-shaped paper sheet conveying path 100 that extends from the document loading tray 2 to the document receiving tray is formed inside the ADF 1.

A pickup roller 5 is disposed at an upstream end of the paper sheet conveying path 100 and an upper position of a front edge portion of a document (of either one or more paper sheets) that is set on the document loading tray 2. The pickup roller 5 feeds the document that is set on the document loading tray 2 from an uppermost paper sheet piece by piece. The picked up paper sheet is conveyed by a feed roller 6 and a conveyance roller 7 that are installed in appropriate positions on the paper sheet conveying path 100; after an image on a document face has been read at a reading section 101, the paper sheet is further conveyed through the paper sheet conveying path 100, and then discharged onto the document receiving tray 3.

Figure 2:
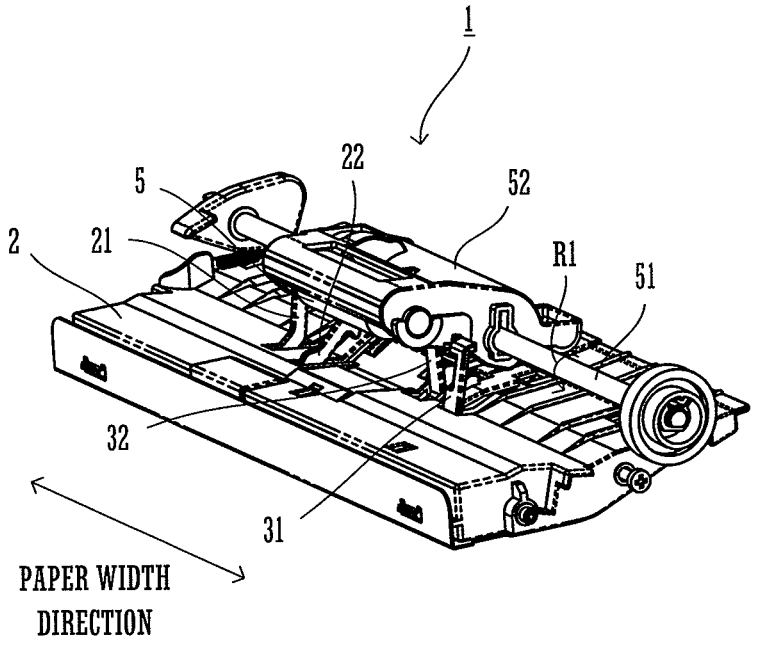
FIG. 2 is a perspective view showing a neighborhood of a paper feeding section of a document loading tray of the paper feeder.

FIG. 2 shows a perspective view of an essential part around the pickup roller 5. A pickup holder 52 is supported by a swing shaft 51 in such a manner as to be capable of being turned. The pickup holder 52 supports the pickup roller 5 in such a manner as for the pickup roller 5 to be rotatable. The pickup holder 52 is turned as shown by the arrow R1 when necessary by a drive motor not illustrated; thereby the pickup roller 5 descends to come into contact with the uppermost paper sheet, and thus becomes ready to feed the paper sheet. In the neighborhood of the pickup roller 5, an actuator is installed in order to sense that one or more paper sheets corresponding to paper widths are set on the document loading tray 2.

The actuator includes a first actuator 21 and a second actuator 22. The first actuator 21 is arranged so as to be adapted for paper sheets of large sizes including normal paper sizes (an example of paper sheets of first sizes in width direction of the present invention). The second actuator 22 is arranged at an inner position than the first actuator 21 in width direction and within widths of business cards (an example of paper sheets of second sizes in width direction of the present invention). Widths of business cards mean widths corresponding to the paper sheets of sizes of business cards.

Also, corresponding to the first actuator 21 and the second actuator 22, a first stopper 31 and a second stopper 32 are installed as means for restraining the paper sheets. The first stopper 31 and the second stopper 32 are members respectively to restrain a set document at a predetermined position.

The second actuator 22 is disposed within a width of the pickup holder 52, and the first actuator 21 is disposed outside the width of the pickup holder 52. What makes it possible to have such an arrangement is that a height of the second actuator 22 is configured so as to be lower than a height of the first actuator 21. This permits the first and the second actuators 21, 22 that protrude from a stacking face of the paper sheet stacking tray 2 to be disposed compactly.

Figure 3:
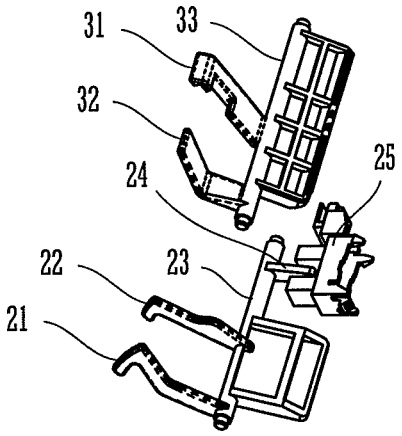
FIG. 3 is a perspective view showing an actuator and a stopper of the paper feeder.

FIG. 3 is a perspective view showing a total view of the actuators and the stoppers. The first actuator 21 and the second actuator 22 are fixed on a common swing shaft 23. The first stopper 31 and the second stopper 32 are fixed on a common swing shaft 33. The swing shafts 23, 33 are disposed beneath a floor of the receiving face of the document loading tray 2. From the swing shafts 23, 33 beneath the floor through openings provided in the receiving face of the document loading tray 2, the first and the second actuators 21, 22, and the first and the second stoppers 31, 32 protrude to an upper side of the receiving face of the document loading tray 2. Here, although the first and the second actuators 21, 22 share the swing shaft 23 as the common shaft in this embodiment, they may otherwise be configured in such a manner as to have separate swing shafts that interlock through a gear or the like. The same applies to the first and the second stoppers 31, 32.

Figure 4:
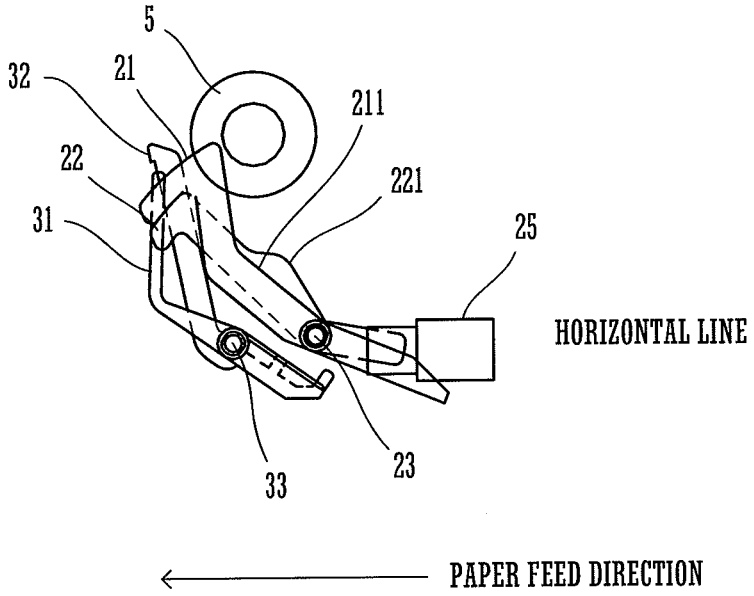
FIG. 4 is a sectional view showing the actuator and the stopper of the paper feeder.

As shown in FIG. 4, ends of the first and the second actuators 21, 22 on an upstream side in the paper feed direction are made to be ends on sensing side 211, 222 (see FIG. 4), so that the first and the second actuators 21, 22 are swung when a front edge of the document that is set on the document loading tray 2 comes into contact with, pushes and moves the ends on sensing side 211, 212.

The end on sensing side 221 of the second actuator 22 is located on the upstream side from the end on sensing side 211 of the first actuator 21 in the paper feed direction. This configuration ensures that the second actuator 22 that is located on the upstream side in the paper feed direction can sense that a paper sheet is set even when the front edge of the paper sheet of a normal paper size that is to be sensed by the first actuator 21 is curled.

That the document is set is determined by sensing the swinging of the first and the second actuators 21, 22 with a sensing switch 25. To be more specific, it is determined that the document is set correctly if the sensing switch 25 is turned on with a sensing piece 24 that is fixed on the swing shaft 23 being turned to a position at which it does not block an optical axis of the sensing switch 25.

The first stopper 31 and the second stopper 32, with which front edges of one or more paper sheets of the document that is set on the document loading tray 2 are brought into contact, perform positioning of the document in the paper feed direction at the time when the document is set. As to the first stopper 31 and the second stopper 32, a detailed explanation will be given in the second embodiment of the present invention.

Figure 5:
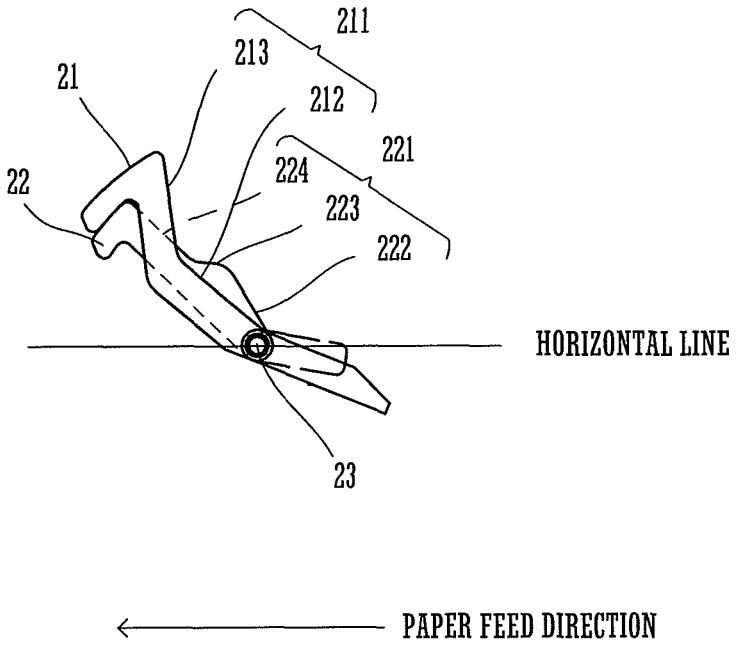
FIG. 5 is a sectional view showing the actuator of the paper feeder.

As shown in FIG. 5, the end on sensing side 211 of the first actuator 21 has a first oblique section 212 and a second oblique section 213. The first oblique section 212 inclines from underside toward upside in height direction toward a downstream side in the paper feed direction. The second oblique section 213 is connected to the first oblique section 212, and its inclination angle is configured so as to be larger than that of the first oblique section 212. The inclination of the first oblique section 212 is set, for example, to 65-75 degrees with respect to a horizontal line as reference.

With the inclination angles from underside toward upside that are configured so as to increase in two stages toward the downstream side in the paper feed direction in this manner at the end on sensing side 211 of the first actuator 21 that senses the paper sheets corresponding to the large sizes including the normal paper sizes, the first actuator 21 can surely sense that even a paper sheet that is curled upward is set on the paper sheet stacking tray 2, because the paper sheet that is curled upward comes into contact with the second oblique section 213 and thereby swings the second oblique section 213 even when it slips off the first oblique section 212.

The end on sensing side 221 of the second actuator 22 has a first oblique section 222, a flat section 223 and a second oblique section 224.

The first oblique section 222 inclines from underside toward upside toward the downstream side in the paper feed direction. The flat section 223 has an inclination that is nearly horizontal (for example, −5 degrees to +5 degrees with respect to the horizontal line as reference), is connected to the first oblique section 222, and has an inclination angle that is smaller than that of the first oblique section 222. The second oblique section 224 is connected to the flat section 223, and is configured so as to have an inclination angle that is larger than that of the first oblique section 222. The inclination of the first oblique section 222 is set, for example, to 40-55 degrees with respect to the horizontal line as reference.

With the inclination angles from underside toward upside that are configured so as to decrease in two stages toward the downstream side in the paper feed direction in this manner at the end on sensing side 221 of the second actuator 22 that senses the paper sheets corresponding to the small sizes including the sizes of business cards, the second actuator 22 can surely sense a paper sheet of a small size that is set on the paper sheet stacking tray 2, because a front edge of even a paper sheet that is curled downward comes into contact with, surely pushes, moves and thereby swings the first oblique section 222 having a large inclination angle. In particular, in the embodiment, it is made possible to set a document of a size of a business card to be set in such a manner as to be placed on the flat section 223, thereby increasing degree of freedom in the manner of setting a document. Here, for paper sheets of the small sizes, for example, there are postcards, envelopes and so forth.

Further, the inclination angle of the first oblique section 222 of the end on sensing side 221 of the second actuator 22 is configured so as to be larger than that of the first oblique section 212 of the end on sensing side 211 of the first actuator 21. This ensures that the first oblique section 222 having a large inclination angle and the flat section 223 of the end on sensing side 221 of the second actuator 22 are located on the upstream side from the first oblique section 212 of the end on sensing side 211 of the first actuator 21 in the paper feed direction, even though the first actuator 21 and the second actuator 22 are fixed on the common swing shaft 23.

This configuration ensures that the first oblique section 222 of the second actuator 22 can sense that a paper sheet is set on the paper sheet stacking tray 2 even when a front edge of the paper sheet of a large size that is to be sensed by the first actuator 21 is curled.

The flat section 223 of the second actuator 22 does not need to be always flat, but may have a slight degree of inclination.

Figure 6:
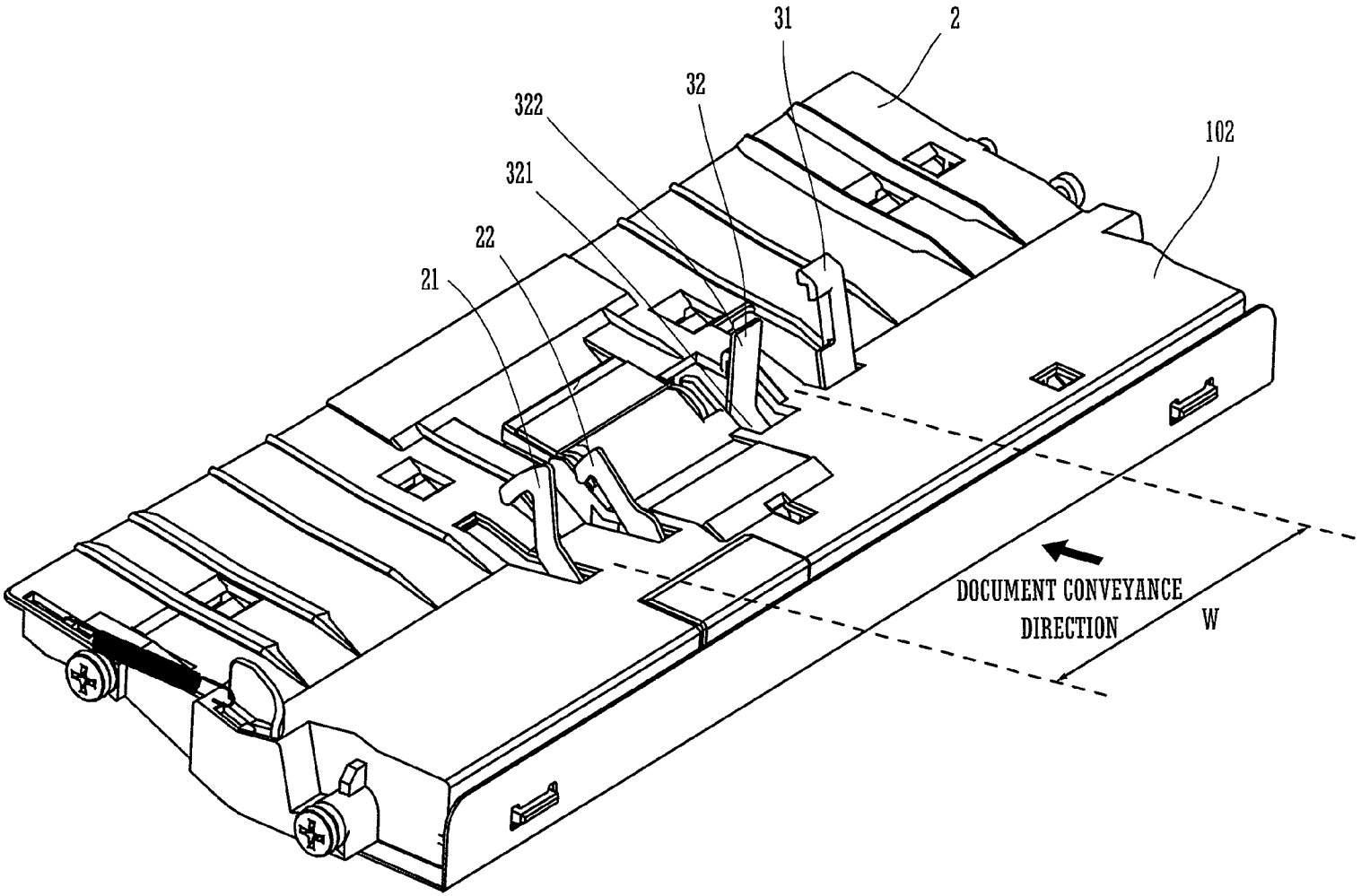
FIG. 6 is a schematic drawing showing a configuration of a lower part of the document loading tray, the actuator and the stopper that are included in the paper feeder of FIG. 2.

In the first embodiment, the first actuator 21 and the second actuator 22 that sense the paper sheets are provided for paper sheets of the normal paper sizes and the small sizes; whereas in the second embodiment, as in FIG. 6, a first stopper 31 for paper sheets of the normal paper sizes and a second stopper 32 for paper sheets of the small sizes are provided in order for a paper sheet not to get into the downstream side when the paper sheet is placed on the document loading tray 2.

Since the first stopper 31 is disposed outside a second size paper sheet passage region (width shown by the sign W in FIG. 2) with the second stopper 32 being disposed within the second size paper sheet passage region, movement of paper sheets of the second width such as business cards can be restrained properly; thus, paper sheets of the second sizes in addition to paper sheets of the first sizes can be fed properly. Here, paper sheets of the first sizes are the normal paper sizes that are normally used such as A4, A3, B4, B3 and so forth; and paper sheets of the second sizes are paper sheets of the small sizes such as business cards, postcards, etc.

As shown in FIG. 6, the first and the second stoppers 31, 32 are installed at a downstream part 102 of the document loading tray 2. The first and the second stoppers 31, 32, are the members to restrain the movement of the document toward the downstream side in the neighborhood of the paper feed position of the pickup roller 5 (not shown) so as to prevent the document from unintentionally getting to the feed roller 6 when it is placed on the document loading tray 2. In this embodiment, the first and the second stoppers 31, 32 are configured so as to be able to deal with paper sheets of the normal paper sizes that are normally used such as paper sheets of A4, A3, B4, B3 sizes and so forth, but also paper sheets of the small sizes such as business cards and postcards, etc. properly.

Specifically, the first and the second stoppers 31, 32 are disposed on one end's side (one side) of the pickup roller 5 (not shown) in a direction of an axis thereof. The first stopper 31 inclines at a predetermined angle toward the downstream side, and is disposed outside the passage region W in a direction perpendicular to a document conveyance direction where paper sheets of the second width pass (the second size paper sheet passage region W: for example, a region of 91 mm in width centered at the middle in width direction of the document loading tray 2; see FIG. 6), and outside a width of the pickup holder 52 (not shown) in the direction perpendicular to the document conveyance direction.

On the other hand, the second stopper 32, including a first piece 321 that inclines more toward the downstream side than the first stopper 31 and a second piece 322 that extends generally vertically in upward direction bending upward from a front edge of the first piece 321, is disposed inside the second size paper sheet passage region W and within the width of the pickup holder 52 in the direction perpendicular to the document conveyance direction. Besides, the second piece 322 of the second stopper 32 is configured so as to be located on the downstream side from the first stopper 31. Moreover, a height of the second stopper 32 is configured so as to be lower than a height of the first stopper 31, and in such a manner that when the pickup roller 5 descends the second stopper 32 is contained within the pickup holder 52.

In this manner, in the second embodiment, resetting of the movement restraint of paper sheets of the first sizes (paper sheets of the normal paper sizes that are normally used such as paper sheets of A4, A3, B4, B3 sizes and so forth) and paper sheets of the second sizes (paper sheets of the small sizes such as business cards and postcards, etc.) is also performed properly at the time when the document is sent out.

As a third embodiment of the present invention, the invention is also applicable to a paper feeder that contains and/or receives paper sheets onto which toner images are to be transferred in an image forming apparatus, as well as ADF. Among such paper feeders are there the paper feed cassette 81, and the hand-fed paper tray 82, as shown in FIG. 7. In each of these paper feed cassette 81 and hand-fed paper tray 82, a structure such as previously described actuator or the like is installed, so that it is made possible to sense paper sheets of A5 to A3 sizes as the normal paper sizes, and paper sheets of, for example, postcard sizes, envelope sizes, business card sizes, etc. as the small sizes.

The above explanations of the embodiments are nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. A paper feeder comprising:

a paper sheet stacking tray;

a pickup roller feeding a paper sheet that is set on the paper sheet stacking tray; and an actuator that protrudes on a stacking face of the paper sheet stacking tray and senses the paper sheet when touched, pushed and moved by a front edge of the paper sheet that is set, wherein the actuator includes a first actuator adapted for paper sheets of first sizes in width direction and a second actuator adapted for paper sheets of second sizes that are smaller than any first size in width direction;

the second actuator is arranged at an inner position of the first actuator in width direction; and an end on sensing side of the second actuator is located on an upstream side from an end on sensing side of the first actuator in a paper feed direction.

2. The paper feeder according to claim 1, wherein the first actuator and the second actuator are fixed on a common swing shaft.

3. The paper feeder according to claim 1, wherein the end on the sensing side of the second actuator includes:

a first oblique section that inclines from underside toward upside in height direction toward a downstream side in the paper feed direction;

a flat section that is connected to the first oblique section and has an inclination that is nearly horizontal; and a second oblique section that is connected to the flat section and has an inclination angle that is smaller than that of the first oblique section.

4. The paper feeder according to claim 3, wherein the end on the sensing side of the first actuator includes:

a first oblique section that inclines from underside toward upside in height direction toward the downstream side in the paper feed direction; and a second oblique section that is connected to the first oblique section and has an inclination angle that is larger than that of the first oblique section.

5. The paper feeder according to claim 3, wherein the inclination angle of the first oblique section of the second actuator is larger than that of the first oblique section of the first actuator.

6. The paper feeder according to claim 1, wherein the second actuator is lower than the first actuator in height direction.

7. The paper feeder according to claim 6, wherein the paper feeder has a movable pickup holder that supports the pickup roller rotatably; and in a direction perpendicular to the paper feed direction, the second actuator is disposed within a width of the pickup holder.

8. An image forming apparatus comprising the paper feeder according to claim 1.

* * * * *